United States Patent [19]

Larson et al.

[11] Patent Number: 4,488,948

[45] Date of Patent: Dec. 18, 1984

[54] CHANNEL FLOW CATHODE ASSEMBLY AND ELECTROLYZER

[75] Inventors: Eric H. Larson; Bruce E. Kurtz, both of Marcellus; Robert H. Fitch, Syracuse, all of N.Y.

[73] Assignee: The Dow Chemical Company, Midland, Mich.

[21] Appl. No.: 522,621

[22] Filed: Aug. 11, 1983

Related U.S. Application Data

[63] Continuation of Ser. No. 324,286, Nov. 23, 1981.

[51] Int. Cl.[3] ..... C25B 1/34; C25B 9/00

[52] U.S. Cl. ..... 204/98; 204/128; 204/129; 204/263; 204/266; 204/288; 204/284

[58] Field of Search ..... 204/98, 128, 256–258, 204/269–270, 275, 278, 288, 289, 129

[56] References Cited

U.S. PATENT DOCUMENTS 4,059,500 11/1977 Kamarian ..... 204/258
4,279,731 7/1981 Pellegri ..... 204/256
4,329,218 5/1982 Sorenson et al. ..... 204/266
4,417,960 11/1983 Pellegri ..... 204/128

*Primary Examiner*—R. L. Andrews
*Attorney, Agent, or Firm*—W. D. Miller

[57] ABSTRACT

A cathode assembly for use in an electrolyzer cell is provided which comprises at least one separating means adjacent to a face of said cathode assembly and comprising a fluid-impervious material and extending diagonally upwards from a point on a first side of said cathode to a point short of a second side opposite the first side of said cathode, said first separating means having a positive monotonic slope with reference to said first side and to a third side adjacent to said first side and thereby separating said face into at least two interconnected regions. The preferred embodiment of the cathode assembly comprises two separating means equipped with downwardly disposed flanges affixed to an edge of said separating means and extending substantially along the full length of said separating means. A process employing the cathode assembly is also disclosed.

7 Claims, 4 Drawing Figures

CHANNEL FLOW CATHODE ASSEMBLY AND ELECTROLYZER

This application is a continuation of U.S. patent application Ser. No. 324,286 filed Nov. 23, 1981.

BACKGROUND OF THE INVENTION

This invention relates to an electrode assembly design to be employed in a permselective membrane electrolyzer cell useful for electrolysis of brine for production of chlorine and alkali metal hydroxide, and more particularly to a cathode assembly design which provides a cathode assembly with channels to produce an aqueous alkali metal hydroxide electrolyte composition having a maximum electrical conductivity and thereby to reduce electrolyzer cell voltage. A process of employing the cathode assembly in an electrolytic cell or bank thereof is also contemplated.

The electrolysis of alkali metal chloride brine, for example sodium chloride, is by far the most important commercial process for producing chlorine and alkali metal hydroxide, especially caustic soda. Recently, there has been tremendous commercial interest in electrolysis cells incorporating metallic anodes rather than graphite anodes used theretofore in this process. Further, there is evolving a clear trend toward the use of cationic permselective membranes rather than conventional permeable deposited asbestos diaphragms in these cells. The permselective membranes differ substantially from the permeable diaphragms in that no hydraulic flow from anode to cathode compartments is permitted. The permselective membranes, typically ion exchange resins cast in the form of very thin sheet, consist of a perfluorinated organic polymer matrix to which inorganic sulfonate groups are attached.

Cationic permselective membrane cells for electrolysis of aqueous alkali metal halide solution to form alkali metal hydroxide and diatomic halide gas are comprised of a housing, an anode and a cathode located within the housing, a cationic permselective membrane separating the anode and the cathode and dividing the housing into an anode compartment and a cathode compartment. In operation, an aqueous alkali metal halide solution is fed to the anode compartment, and water or aqueous alkali metal hydroxide solution is fed to the cathode compartment. A direct electric current is made to flow from the cathode to the anode. It is the primary function of the cationic permselective membrane to permit passage of only positively charged alkali metal ions from the anode compartment to the cathode compartment; negatively charged ions are substantially inhibited from passing through the membrane, as a consequence of the nature of the membrane.

Thus, during electrolysis of sodium chloride brine, the negatively charged groups permit transference of current-carrying sodium ions across the membrane while excluding chloride ions. Consequently, it is now possible to produce caustic soda of a predetermined concentration and nearly free of chloride within the cathode compartment.

Maximum utility of a system incorporating metallic anodes and permselective membranes is achieved by a multi-cell design wherein cells are arranged in serial fashion. An anode mounted on one cell frame faces the cathode mounted on the adjoining cell frame. Between the two cell frames is interposed a cationic permselective membrane. In a configuration such as this, it is important to have the paired anode and cathode parallel to each other. This permits one to minimize the interelectrode gap and the cell voltage drop due to the fluid paths in the cathode and anode chambers.

U.S. Pat. No. 4,115,236 discloses an intercell connector which provides direct electrical communication and secure mechanical connection between cells of an electrolyzer.

U.S. Pat. No. 4,115,236 discloses a design for a cathode assembly for a plural cell electrolyzer which provides a cathode with an essentially flat surface for use in the electrolysis of brine for production of chlorine and caustic soda.

Just as there are factors which cause the actual current drawn by a cell to exceed the current theoretically corresponding to the amount of product actually produced, some of which have been discussed above, there are factors which cause the voltage requirement to exceed the theoretical decomposition voltage for the anode and the cathode reactions. The voltage efficiency of the cell is the theoretical decomposition voltage for the desired overall reaction, divided by the actual voltage across the cell, expressed as percent.

For example, for a cell for electrolysis of aqueous sodium chloride to form sodium hydroxide, chlorine and hydrogen, the actual voltage across a cell is determined by the following relationship:

$$E = E_o + \frac{RT}{F} \ln \frac{{}^{a}NaOH^{2}{}^{a}Cl_2{}^{a}H_2}{{}^{a}NaCl^{2}{}^{a}H_2O^{2}} + kI$$

wherein "$E_o$" is the theoretical decomposition voltage (2.3 volts in the case of NaCl), "RT/F" is a factor variable only with the temperature of the electrolyte (T), "a" denotes the activities (concentrations times the activity coefficients) of the products and the reactants, and "k" is the sum of all the ohmic resistances in the cell, that is of all the resistances which are at least approximately proportional to the current, "I".

A typical cell for electrolysis of sodium chloride solution, whether diaphragm cell or permselective membrane cell, may operate at a total voltage of about 4 volts. The difference between this practical operating voltage and the theoretical decomposition voltage resides in the last two terms of the above equation. The activity term (the term in the middle of the right hand side of the above equation) reflects the effect of product and reactant concentrations. The last term includes the electrical resistance across the electrolyte and the membrane separating the electrodes, the resistance through the electrodes, and the resistance through electrode connections. For the sake of convenience, one may also include herein the effect of electrode polarization due to, for example, accumulation of evolved gas on the surface on the electrodes and local concentration gradients.

The overall efficiency with which a cell converts electrical energy to useful products is measured by the power efficiency, which is simply the product of the current and the voltage efficiencies.

Current efficiency as used herein denotes the fraction, expressed as percent by weight, of the amount of alkali metal hydroxide actually produced in a cell or a bank of a plurality of cells, divided by the theoretical amount of alkali metal hydroxide that should have been produced in the cell or the bank of cells for a given amount of electrical current actually passed therethrough.

In order to reduce the expense of subsequent evaporation of the alkali metal hydroxide solution as obtained from the electrolysis process to obtain more concentrated solution containing in the order of about 50 percent alkali metal hydroxide, the usual form in which such solutions are sold, it would be desirable to operate the cells with the highest possible hydroxide ion concentration in the cathode compartment. However, with increasing hydroxide ion concentration the current efficiency is reduced due to increased back-migration of hydroxide ion. Increasing hydroxide ion concentration also tends to decrease the voltage efficiency (due to the influence of the product and reactant activity term in above equation), although this effect is reduced by the concurrent decrease in the electrical resistance of the catholyte, thus reducing the contribution of the ohmic term to the total voltage.

While it is true that a higher cell current efficiency as well as, perhaps, higher voltage efficiency can be achieved by maintaining a lower overall hydroxide ion concentration in the sum total catholyte compartments of a bank of permselective membrane cells, it has been found that the influence of changes in the current efficiency becomes far more significant than the influence of changes in the cell voltage which occur in response to changes in the catholyte hydroxide ion concentration. Under these circumstances, total cell operating efficiency, which is the power efficiency, will be determined predominantly by the current efficiency.

U.S. Pat. Nos. 4,057,474 (Kurtz et al.) and 4,181,587, (Kurtz) describe a technique known as "series catholyte flow" wherein one or more cells are fed water, the resultant caustic product is then fed to one or more cells in sequence, and the product continuing to be fed in a sequential manner until the desired caustic strength is reached.

U.S. Pat. No. 4,057,474 (Kurtz et al.) describes a process for electrolyzing sodium chloride brine in membrane cells in which current efficiency is improved. This improvement is accomplished by operating a bank of a plurality of cells and causing the catholyte to pass from the cathode compartment of a first cell to the cathode compartment of one or more succeeding cells in the bank, i.e., by operating in series catholyte flow.

U.S. Pat. No. 4,181,587 (Kurtz) describes a process for producing chlorine and caustic soda involving a bank of electrolytic membrane cells arranged for series catholyte flow wherein power efficiency is improved by maintaining at least two of the initial cells in the bank in parallel catholyte flow, combining the catholyte streams from such initial cells and introducing the combined catholyte into the cathode compartment of one or more succeeding cells in the bank.

While the series catholyte flow technique disclosed in U.S. Pat. Nos. 4,057,474 and 4,181,587 achieved a goal of operating at electrolyte near the conductivity maximum with improved current efficiency, this technique requires additional hydraulic complexity in the external piping system to achieve said goal.

Other prior art patents of interest include U.S. Pat. Nos. 4,142,950; 4,108,756; 4,101,410; and 3,297,561; these patents all deal with the design of electrodes to enhance gas flow in catholyte or anolyte compartments.

Since the principal economic factor for processes which produce chlorine and caustic soda is electric energy, attempts are constantly being made to improve the efficiency of the use of this energy.

Accordingly, there is still a need for an improved electrode design which improves the power efficiency in the production of chlorine and alkali metal hydroxide without employing extensive external piping.

It is an object of this invention to provide an electrode design for a permselective membrane electrolyzer cell to improve the cell's power efficiency.

It is another object of this invention to provide a cathode assembly design for use in a permselective membrane electrolyzer cell to establish within at least a cathode compartment of said electrolyzer cell at least a partial zone which operates at the conductivity maximum for the aqueous alkali metal hydroxide electrolyte and thereby improves said cell's power efficiency.

It is still another object of this invention to provide an electrolytic process for production of alkali metal hydroxide, hydrogen and chlorine by employing the cathode assembly in a permselective membrane electrolyzer cell.

These and other objects and advantages will be evident from the description herein.

SUMMARY OF THE INVENTION

In accordance with the objects and advantages of the present invention, there is provided an improved cathode assembly for use in an electrolyzer cell. The improvement comprises at least one separating means adjacent to a face of said cathode assembly and comprising a fluid-impervious material and extending diagonally upwards from a point on a first side of said cathode to a point short of a second side opposite the first side of said cathode, said first separating means having a positive monotonic slope with reference to said first side and to a third side adjacent to said first side and thereby separating said face into at least two interconnected regions.

In accordance with the objects and advantages of the present invention, there is also provided an improved method for the production of alkali metal hydroxide and chlorine gas by electrolysis of alkali metal chloride brine in an electrolysis cell having a cathode compartment containing a cathode assembly and an anode compartment containing an anode assembly wherein:

(a) aqueous alkali metal chloride brine is introduced into the anode compartment of said cell;
(b) water or dilute alkali metal hydroxide is introduced into the cathode compartment of said cell;
(c) said compartments are separated by a cation permselective membrane;
(d) chlorine gas produced in the anode compartment and depleted brine are withdrawn therefrom; and
(e) alkali metal hydroxide produced in the cathode compartment having the desired concentration and hydrogen gas are withdrawn therefrom. The improvement comprises increasing the power efficiency of the electrolysis cell by (1) providing at least two interconected zones, a lower zone and at least one upper zone, within the cathode compartment; (2) producing alkali metal hydroxide and hydrogen gas in the lower zone into which water or dilute alkali metal hydroxide is introduced; (3) maintaining the concentration of alkali metal hydroxide in the lower zone at substantially about the conductivity maximum for said concentration; (4) passing the alkali metal hydroxide from the lower zone to at least one upper zone wherein the concentration of alkali metal hydroxide is increased to the desied concentration; and (5) recovering the alkali metal hydroxide having the desired concentration.

BRIEF DESCRIPTION OF THE DRAWINGS

The invention will be better understood and additional advantages will become apparent when reference is made to the following description and accompanying drawings wherein.

DESCRIPTION OF THE PREFERRED EMBODIMENTS

Figure 1:
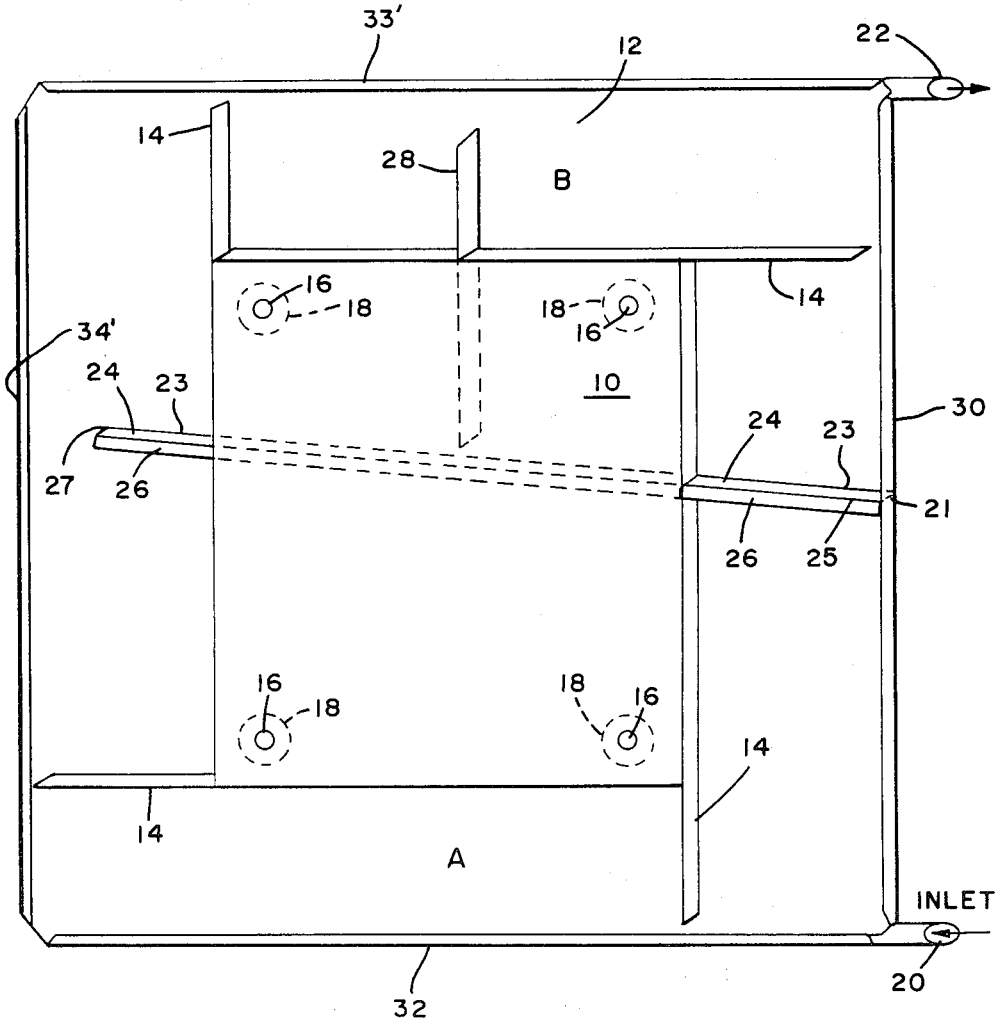
FIG. 1 is an elevation view of an embodiment of a cathode assembly of this invention employing a single separating means and a single baffle.

The cathode assembly of the present invention is designed for use as part of the cathode compartment in conjunction with a plural cell, bipolar permselective membrane electrolyzer. The cathode assembly is especially adapted for use in an electrolyzer which receives an input to anode compartment of alkali metal halide brine for the conversion thereof to halogen and alkali metal hydroxide. Water or dilute alkali metal hydroxide is fed to inlet disposed in the bottom of the cathode compartment, and hydrogen gas and more concentrated alkali metal hydroxide are removed via an outlet at the top thereof.

Prior art permselective membrane electrolyzers used for the production of chlorine gas and alkali metal hydroxide operate as idealized stirred tank reactors wherein each cell operates at substantially product stream conditions. Accordingly, if a prior art cell is producing 25 wgt. % alkali metal hydroxide, the operating conditions within this cell will be those of a 25 wgt % alkali metal hydroxide. R. H. Fitch et al. in "Chlorine/Caustic Soda Production in a Permselective Membrane Electrolyzer Employing Series Catholyte Flow", Proceedings of the 155th Meeting of the Electrochemical Society, Boston, MA (May 9, 1979) disclose that the conductivity maximum of an electrolyte and corresponding cell voltage minimum occur at conditions other than product stream conditions. Specifically, R. H. Fitch et al. disclose that for 18 wgt % product sodium hydroxide stream, the conductivity maximum occurs at 13 wgt % sodium hydroxide.

The cathode assembly of the present invention employs at least one separating means adjacent to a face of said cathode assembly and comprises a fluid impervious material and extends diagonally upwards with a positive monotonic slope to separate the cathode assembly into two interconnected regions. When the cathode assembly of the present invention having at least one separating means is used in a cathode compartment, at least two interconnected chambers are formed: one lower and a first upper. The composition of alkali metal hydroxide produced in the lower chamber so formed is in the range of about 12 to 15 wgt % alkali metal hydroxide, which substantially approximates the conductivity maximum for alkali metal hydroxide. Surprisingly, a permselective electrolyzer cell employing the cathode assembly of the present invention operates at a cell voltage lower by approximately 0.07 volts thereby increasing the cell's power efficiency by about 2% in comparison to prior art permselective cells employing a cathode assembly as disclosed in U.S. Pat. No. 4,115,236.

The alkali metals of commercial importance are sodium and potassium. Accordingly, the components of the cathode assembly and permselective membrane electrolyzer are chosen from a design and material viewpoint with the highly corrosive chemicals such as sodium hydroxide, potassium hydroxide and chlorine in mind.

The cathode assembly of the present invention comprises at least one, preferably one to four, separating means. A cathode assembly comprising two separating means is more preferred.

The separating means are positioned adjacent to, preferably affixed to, a face of the cathode assembly.

Referring to the drawings in more detail, FIG. 1 shows a rigid cathode support 10 joined to cathode 12 by connecting member 14. The materials from which the cathode support, cathode, and connecting members are fabricated should be electrically conductive and resistant particularly to hydroxyl ions. Typically, these elements of the cathode assembly are fashioned from metal selected from the group consisting of iron, steel, cobalt, nickel, manganese and the like, iron and steel being preferred. Although it is not essential that the elements all be fabricated from the same metal, some corrosion problems can be avoided by doing so. The cathode must be of foraminous material to allow release of gas from front surface of cathode. The connecting members serve both to ensure that the cathode maintains a flat surface and to provide electrical communication between cathode and support. The connectors must be of foraminous material to permit the hydrogen evolved on the cathode to rise to the surface of the catholyte. The foraminous material of the cathode and connectors may be expanded metal or, preferably, perforated metal sheet. Most preferably, these elements comprise perforated low-carbon steel sheets. Instead of sheet, the connectors may alternatively be either angle or channel.

A purpose of the cathode support is to ensure that the paired anode/cathode elements are parallel. To accomplish this purpose, the support must be rigid and have an accurately flat face. Adequate rigidity may be achieved with a support area about 1% of the cathode area; however, preferably the support area covers at least about 25% of the cathode area. The support should comprise a metal plate at least about 4.5 mm thick. Precision surface grinding of the support faces is the preferred method for achieving the required flat face.

FIG. 1 also shows other elements of the cathode assembly, including through bores 16 in the cathode support through which the intercell connectors join the cathode support to the anode in an adjacent cell. Through bores 18 in the cathode provide access to the heads of the intercell connectors. To ensure a smooth edge for the holes 18, there are no perforations punched in the cathode on the perimeter of said holes. In the preferred embodiment, the cathode 12 is cut at the corners and folded at about a 90° angle around the edges to assist in achieving flatness after the punching step. Where reference is made herein to the flat surface of the cathode and to the requirement that anode and cathode surfaces be parallel, these folded edges are obviously excluded.

Referring again to FIG. 1, separating means 24 is positioned adjacent, preferably affixed via a first edge 23 of separating means 24, to a face of cathode 12 and extends diagonally upwards from a point 21 on a first side 30 of said cathode 12 to a point 27 short of second side 34' opposite the first side 30 of cathode 12. The separating means 24 has a positive monotonic slope with reference to said first side 30 and to third side 32 adjacent to said first side 30 and thereby separating said face of cathode 12 into two interconnecting regions: one lower, designated A and one upper, designated B.

Separating means 24 is preferably affixed to a face of cathode 12 and more preferably is disposed substantially perpendicular to said face of said cathode 12.

While it is preferred that separating means 24 be affixed to the face of cathode 12 opposite from the permselective membrane, it is considered within the scope of the present invention to affix separating means 24 to either one or both faces of cathode 12. In the most preferred embodiment of the present invention, the separating means 24 is affixed to the same face of cathode 12 having cathode support 10.

Figure 2:
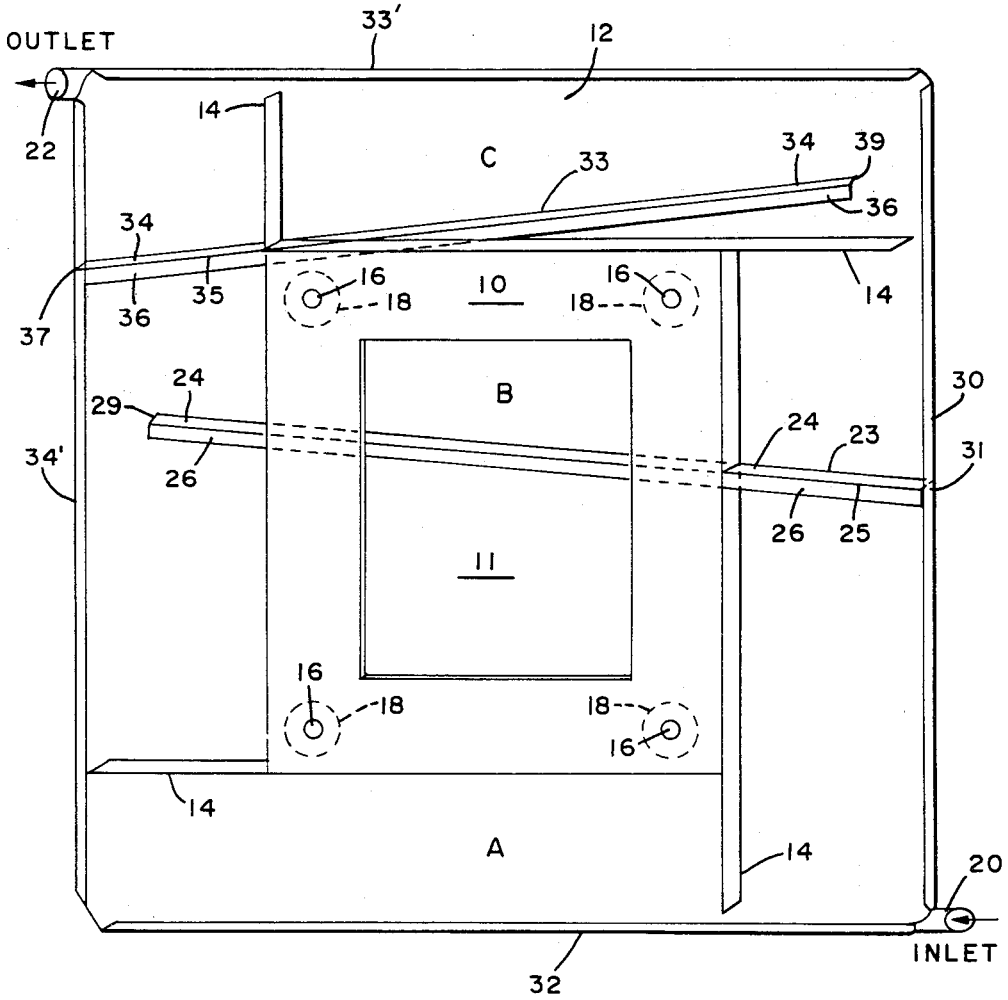
FIG. 2 is an elevation view of an alternate embodiment of a cathode assembly employing two separating means and no baffles.
Figure 3:
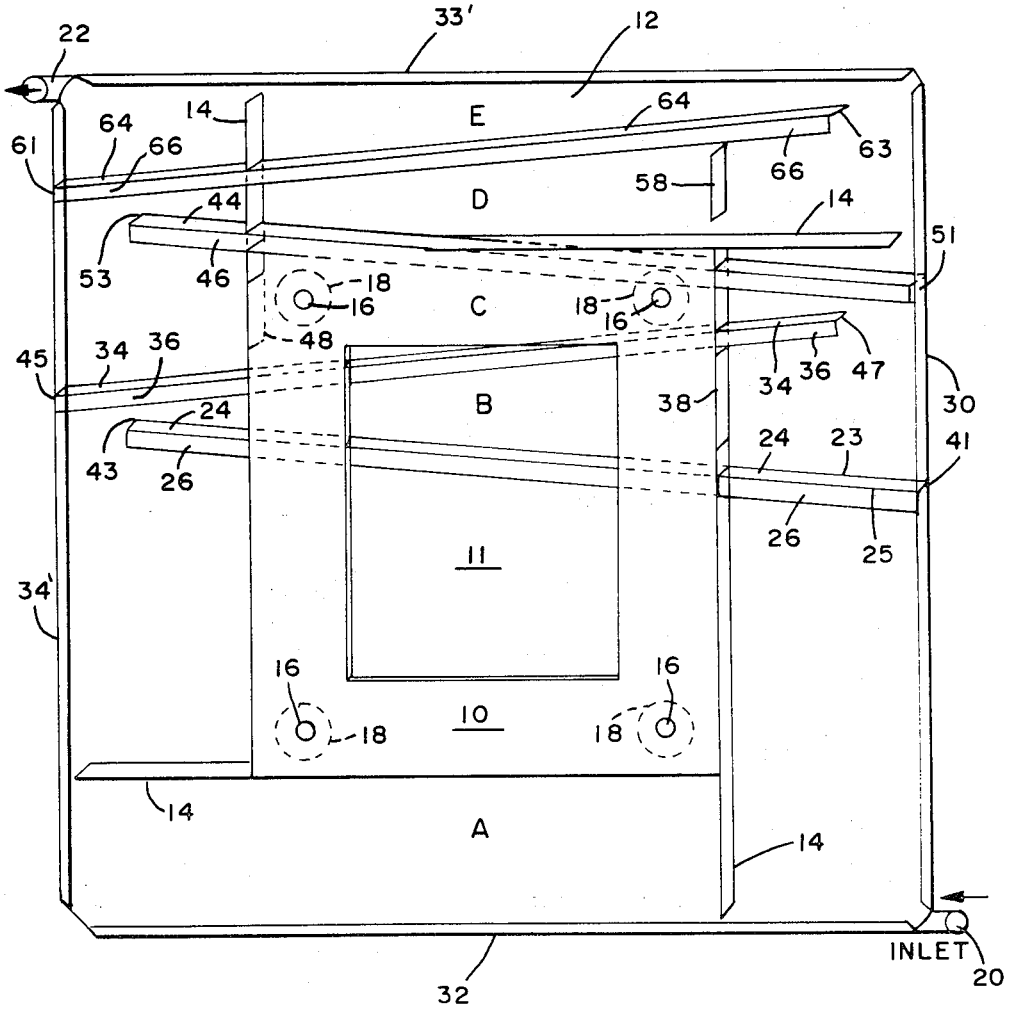
FIG. 3 is an elevation view of an alternative embodiment of a cathode assembly of the invention employing four separating means and three baffles.

While separating means 24 may be displaced as in FIGS. 1–3, it is understood that any configuration or design such as snake-like may be employed so long as the slope thereof is monotonic so as to prevent formation of dead zones for gas and/or liquid along the length of the separating means.

By the term "monotonic slope" as used herein, it is meant that the sign of the first derivative of a mathematical function or curve which defines a separating means never changes in the region of interest, i.e., the face of the cathode.

Preferably, a downwardly disposed flange 26 is affixed to a second edge 25 opposite the first edge 23 and extending along substantially the full length of separating means 24.

Both separating means 24 and flange 26 are comprised of any fluid impervious material such as plastic or mild steel; preferably the same material, though fluid impervious, as used for fabrication of cathode support 10 and cathode 12.

Baffle 28 is disposed adjacent, preferably affixed to, a face of said cathode 12 in upper region B. Preferably, baffle 28 comprises a fluid permeable or fluid impervious material and is disposed in a direction substantially parallel with first side 30 of cathode 12. More preferably, said baffle 28 is affixed substantially perpendicular to said face of said cathode 12. When baffle 28 is fabricated of fluid impervious material, said baffle should be positioned in region B so as not to intersect with any side, e.g. side 331 of said cathode 12 or separating means 24.

The purpose of baffles is to restrict axial dispersion of alkali metal hydroxide electrolyte in at least one upper region such as B in FIG. 1 and to force region B to operate like a plug flow reactor wherein only the electrolyte concentration at the exit port is at the high, undesirable product concentration. The alkali metal hydroxide electrolyte concentration in the lower region A separated from upper region B by separating means 24 substantially approximates the conductivity maximum for alkali metal hydroxide.

FIGS. 2 and 3 show elevation views of alternative embodiments of the cathode assembly. Preferably, as shown in the Figures, the center of cathode support 10 is positioned substantially over the center of cathode 12, with the two elements having the same orientation, i.e., the edges of the cathode are parallel to the corresponding edges of the support. FIGS. 2 and 3 also show the preferred embodiment of the cathode support 10 of this invention, in which a substantially rectangular cutout 11 yields a picture frame configuration. The center of the cutout substantially coincides with the center of the support, and the cutout and support have substantially the same orientation. The primary advantage of the cutout is a substantial weight reduction. The cutout must, however, not be so large that the support lacks rigidity; thus the area of the cutout must be no greater than about 50% of the area enclosed by the outer perimeter of the support.

FIG. 2 shows a preferred embodiment of the cathode assembly of the present invention employing two separating means 24 and 34, each equipped with downwardly disposed flanges 26 and 36, respectively, thereby separating the face of cathode 12 into three interconnected regions: a lower, designated A; a first upper, designated B and a second upper, designated C, with the proviso that said first and second separating means 24 and 34 do not intersect. The flanges 26 and 36 are affixed to edges 25 and 35 of separating means 24 and 34, respectively, and extend along substantially the full length of said separating means.

The preferred embodiment of the present invention shown in FIG. 2 does not comprise baffle; the use of baffle depends on the individual operating condition, e.g. current density.

FIG. 3 displays an alternate preferred embodiment of the present invention wherein four separating means, 24, 34, 44 and 64, equipped with downwardly disposed flanges 26, 36, 46 and 66, respectively, are employed thereby separating the face of said cathode into five interconnected regions, designated: A (lower), B (first upper), C (second upper), D (third upper) and E (fourth upper) with the proviso that said first (24), second (34), third (44) and fourth (64) separating means do not intersect. Each of the separating means is disposed adjacent to, preferably affixed to, a face of cathode 12 and extends diagonally upwards with monotonic slopes of alternating signs.

Baffles 38, 48, and 58 are adjacent to a face of cathode assembly and are disposed in upper regions B, C and D, respectively, substantially parallel to sides 30 and 34 of cathode 12. For convenience, baffles 38, 48 and 58 are comprised of fluid-impervious material and are incorporated as part of connecting members 14.

The cathode assembly of the present invention need not be rectangular or comprise a rigid cathode support 10 or picture window 11. In addition, while the FIGS. 1–3 show separating means adjacent to the same face of cathode as said cathode support, it is understood that said separating means and said cathode support may be on opposite faces of said cathode. Further, it is considered within the scope of the present invention that the separating means may be affixed to webbing means (not shown) that may be disposed adjacent to either face of cathode. In addition, the cathode assembly of this invention may form a cathode compartment incorporated in a permselective membrane electrolyzer cell in a bank of a plurality of cells adapted to operate in series catholyte flow as disclosed in U.S. Pat. No. 4,057,474, or modified series parallel catholyte as disclosed in U.S. Pat. No. 4,181,587.

The present invention also contemplates a process of using the cathode assembly of the present invention to produce alkali metal hydroxide, hydrogen and chlorine gas by an electrolysis of alkali metal chloride brine in electrolysis cell or bank of electrolysis cells each having a cathode compartment containing a cathode assembly separated from an anode compartment containing an anode assembly by a permselective membrane, preferably a cation permselective membrane. Aqueous alkali metal chloride brine of any convenient concentration is introduced into the anode compartment and water or dilute alkali metal hydroxide is introduced into the cathode compartment of each cell. Under the influence of electric current, sodium ions, but not chloride ions, migrate through the preferred cation permselective membrane from the anode compartment into the cathode compartment wherein alkali metal hydroxide and hydrogen gas are formed.

Prior art permselective membrane cells for electrolysis of alkali metal chloride brine suffur from the disadvantage that each cell operates like an idealized stirred tank reactor at substantially product stream conditions. Thus, if a given cell is producing 25 weight percent alkali metal hydroxide by electrolysis of alkali metal chloride brine, the operating conditions within the cell are approximately those of 25 weight percent alkali metal hydroxide. These prior art stirred tank reactors may operate at conditions equivalent to the product streams conditions which are different from the conductivity maximum for the alkali metal hydroxide electrolyte and thereby consume more electrical energy.

The process of the present invention employs the cathode assembly of the present invention to provide at least two interconected zones, one lower and at least one upper zone, within the cathode compartment containing the cathode assembly. The concentration of alkali metal hydroxide produced in the lower zone is maintained at substantially the conductivity maximum for said concentration. The alkali metal hydroxide produced in the lower zone is then passed to at least one upper zone wherein the concentration of alkali metal hydroxide is increased to the desired concentration.

The number of interconnected zones found useful in the process of the present invention is at least two, preferably two to five, more preferably two. The fluid impervious separating means described hereinabove are employed to provide the interconnected zones.

While permselective electrolysis using the process of the present invention operates to produce alkali metal hydroxide and chlorine gas at increased cell power efficiency so long as at least a portion of the alkali metal hydroxide produced in the lower zone is maintained at the conductivity maximum for that concentration of alkali metal hydroxide, it is preferred to maximize the volume of alkali metal hydroxide having the concentration that provides the conductivity maximum.

When 18 weight percent alkali metal hydroxide is the desired product concentration and a water feed for cathode is utilized, the conductivity maximum occurs at 13 weight percent alkali metal hydroxide. To maximize the volume of the cell's cathode compartment provided with two interconected chambers that operates at 13 weight percent alkali metal hydroxide, the separating means should be disposed so that about 13/18 or 72% of the cathode compartment is preferably occupied by the lower zone.

The separating means comprise a fluid impervious material and have a monotonic slope. The precise slope is not critical. Slopes found useful are in the range of about 0.1 to about 0.5.

When 25 weight percent alkali metal hydroxide is the desired product concentration for a cathode compartment having three interconnected zones, the conductivity maximum occurs at about 15 weight percent alkali metal hydroxide. To maximize the volume of the cell's cathode compartment that operates at this conductivity maximum, about 55% of the cathode compartment is preferably occupied by the lower zone, about 23% by the first upper and about 22% by the second upper zone. Of course baffles may be provided in the first and second upper zones in the preferred embodiment of the process of the present invention.

The following examples are intended to illustrate, but not to limit, the present invention compared to the broader scope set forth in the claims that follow.

EXAMPLE 1

Figure 4:
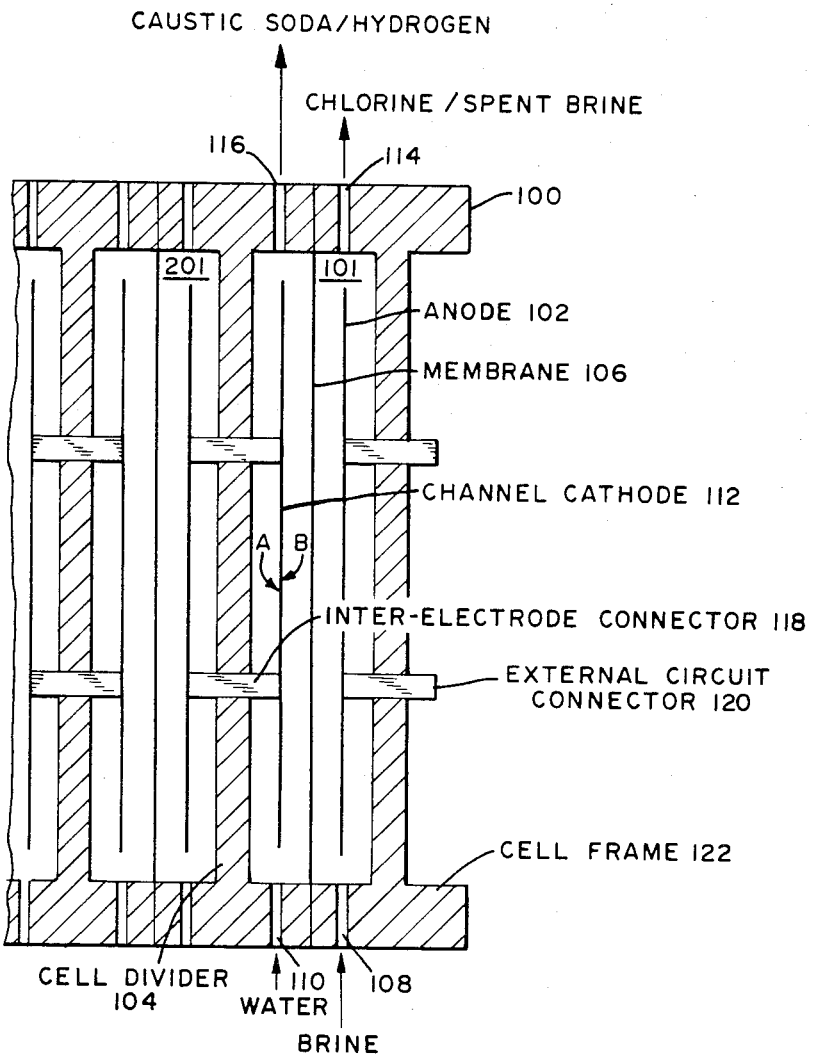
FIG. 4 illustrates a permselective membrane electrolyzer employing the cathode assembly of the present invention.

An electrolyzer 100 of five electrochemical cells (101, 201, 301, 401 and 501) in a bipolar filter press arrangement illustrated in FIG. 4 is used. Each cell, e.g. 101, contains an anode 102, preferably ruthenium dioxide coated titanium expanded metal with current collection means; a cell divider constructed of mineral filled polypropylene; a cathode 112 as described in FIG. 3; a perfluoro sulfonic acid cation exchange permselective membrane 106, e.g. DuPont's NAFION® 390 membrane, and a means for feeding brine 108 and water 110 in a parallel fashion to the anode and cathode compartments, respectively. (See FIG. 4). In operation, face B of cathode 112 is pushed against facing side of cation permselective membrane 102 and separating means are affixed to face A of cathode 112.

The cell is operated in a continuous fashion with a current load of 2500 amperes; each cell is fed 0.8 liters/min of 280 g/l sodium chloride brine and 0.35 l/min water to the anode and cathode compartments respectively of each cell. The cell is allowed to operate until steady state conditions are achieved. The solution leaving compartments A, B, C, D and E of the cathode compartments is found to average 12.5, 14.6, 16.5, 18.5 and 20.3 weight percent sodium hydroxide respectively. The cell voltage is found to average 3.7 volts. The power efficiency is found to be 0.53.

EXAMPLE 2

The electrolyzer of Example 1 is modified by replacing the cathodes of FIG. 3 with cathodes identical except that no baffle or seperator means are attached to the cathode. The resulting electrolyzer is then operated under the conditions of Example 1.

The resulting solution leaving the cathode chambers then has an average concentration of 19.6 weight percent sodium hydroxide and the cell voltage is 3.9 volts per cell. The power efficiency is 0.47.

Other changes and modifications in the specifically described embodiments can be carried out without departing from the scope of the invention which is intended to be limited only by the scope of the appended claims.

We claim:

1. A method for reducing vertical mixing of the catholyte and increasing the energy efficiency of an electrolysis cell having a permselective membrane separating anode and cathode compartments in the electrolysis of an alkali metal chloride solution wherein an aqueous alkali metal chloride solution is fed to the bottom of the anode compartment and water or a dilute alkali metal hydroxide solution is fed to the bottom of the cathode compartment, chlorine gas and depleted brine are withdrawn from the top of the anode compartment and alkali metal hydroxide solution and hydrogen gas are withdrawn from the top of the cathode compartment, the improvement comprising reducing the vertical mixing of the alkali metal hydroxide solution in the cathode compartment with a baffle between the cathode and the permselective membrane attached perpendicularly to the face of the cathode and extending diagonally upward from one side of the cathode compartment to a point short of the opposite side of the cathode compartment providing a passage for fluid flow in the cathode compartment between the end of the baffle and said opposite side of the cathode compartment.

2. The method of claim 1 wherein the cathode compartment contains two or more baffles positioned such that the passages for fluid flow for adjacent baffles are at opposite sides of the cathode compartment.

3. A cathode assembly which retards vertical mixing of the catholyte in an electrolyzer cell having a permselective membrane between the anode and cathode compartments, the assembly comprising a vertical substantially flat foraminous metal cathode, one or more fluid impervious baffles between the cathode and the permselective membrane dividing the cathode compartment into two or more vertically disposed regions, each baffle extending diagonally upward from one side of the cathode compartment to a point short of the opposite side of the cathode compartment thereby providing a passage around the end of the baffle for fluid from the region below the baffle to the region above the baffle, the baffles being positioned such that the fluid passages for adjacent baffles are at opposite sides of the cathode compartment whereby catholyte injected at the bottom of the cathode compartment and hydrogen evolved at the cathode flow upward through the regions of the cathode compartment without any backflow of catholyte from an upper region to a lower region and with the path of catholyte and hydrogen flow being generally upward and from side to side through the regions of the cathode compartment defined by the sides of the compartment and the baffles, and means for withdrawing the catholyte and hydrogen at the top of the cathode compartment.

4. The cathode assembly of claim 3 wherein the baffle has a downwardly disposed flange along the side opposite the side attached to the cathode forming a channel below the baffle between the flange and the face of the cathode to collect gas bubbles rising along the face of the cathode and conduct the gas to the fluid passage between the end of the baffle and the opposite side of the cathode compartment.

5. The cathode assembly of claims 3 or 4 wherein the cathode is substantially rectangular and is stiffened to maintain a flat face by a rigid metal support panel parallel to the face of the cathode, the perimeter of the support panel being attached to the face of the cathode by means of electrically conductive fluid-permeable members, the support panel being on the same face of the cathode as teh baffles.

6. The cathode assembly of claim 5 wherein the support panel is attached to the face of the cathode opposite to the face having the baffles attached.

7. The cathode assembly of claim 5 wherein the support panel is approximately centrally positioned on the face of the cathode, the area of the support panel is at least about 25% of the cathode area and the members attaching the support panel to the face of the cathode extend beyond the perimeter of the support panel to a point near the side of the cathode comparment, thereby further stiffening the cathode.

* * * * *